US012458861B2

(12) United States Patent
Sloan

(10) Patent No.: US 12,458,861 B2
(45) Date of Patent: Nov. 4, 2025

(54) GOLF SIMULATOR THAT FOLDS INTO A CABINET

(71) Applicant: Brent William Sloan, Shadyside, OH (US)

(72) Inventor: Brent William Sloan, Shadyside, OH (US)

( * ) Notice: Subject to any disclaimer, the term of this patent is extended or adjusted under 35 U.S.C. 154(b) by 128 days.

(21) Appl. No.: 18/498,735

(22) Filed: Oct. 31, 2023

(65) Prior Publication Data

US 2025/0135313 A1 May 1, 2025

Related U.S. Application Data

(60) Provisional application No. 63/402,725, filed on Aug. 31, 2022.

(51) Int. Cl.
*A63B 69/36* (2006.01)

(52) U.S. Cl.
CPC ..... *A63B 69/3623* (2013.01); *A63B 2210/06* (2013.01)

(58) Field of Classification Search
CPC ..... A63B 69/3623; A63B 2210/06
USPC ..... 312/324, 329; 108/33, 34; 273/317.2
See application file for complete search history.

(56) References Cited

U.S. PATENT DOCUMENTS 2,566,256 A * 8/1951 Snyder ..... A47B 83/045 312/310
3,288,467 A * 11/1966 Rudolph ..... A63F 7/0628 273/386
4,177,994 A * 12/1979 Lindquist ..... A63B 24/0021 473/156
5,024,441 A * 6/1991 Rousseau ..... A63B 24/0021 473/155
5,513,574 A * 5/1996 Collins ..... A47B 5/06 108/70
11,352,079 B1 * 6/2022 Cash ..... B60P 3/025
2005/0209014 A1 * 9/2005 Kim ..... A63B 24/0021 473/157
2011/0070961 A1 * 3/2011 Nicora ..... A63B 71/022 473/409
2011/0118040 A1 * 5/2011 Ashby ..... A63B 69/3623 473/409
2012/0052949 A1 * 3/2012 Weitzner ..... A63B 69/0026 463/36
2025/0018851 A1 * 1/2025 Todd ..... B60P 3/025

FOREIGN PATENT DOCUMENTS

CA 2493002 C * 9/2012 ..... A63B 24/0021
CN 104922885 A * 9/2015
CN 109419182 A * 3/2019
JP 2009285453 A * 12/2009 ..... A63B 57/357
JP 2011019659 A * 2/2011
KR 200415229 Y1 * 4/2006
KR 20220102674 A * 7/2022
WO WO-8601735 A1 * 3/1986
WO WO-03086553 A1 * 10/2003 ..... A63B 63/00

* cited by examiner

*Primary Examiner* — Kimberly T Wood
(74) *Attorney, Agent, or Firm* — Dunlap Bennett & Ludwig, PLLC; Anna L. Kinney

(57) ABSTRACT

A golf simulator folds into a cabinet in the manner of a Murphy bed. Our unit allows people to play a round of golf. Then when finished, close the unit and use the space for other purposes. For example, the customer can play golf, fold up the unit and pull their car back in the garage.

10 Claims, 4 Drawing Sheets

GOLF SIMULATOR THAT FOLDS INTO A CABINET

CROSS-REFERENCE TO RELATED APPLICATION

This application claims the benefit of priority of U.S. provisional application No. 63/402,725, filed 31 Aug. 2022, the contents of which are herein incorporated by reference.

BACKGROUND OF THE INVENTION

The present invention relates to golf simulators and, more particularly, to a golf simulator that folds into a cabinet.

Most people are not able to have a golf simulator because they do not have a dedicated space they can use for it.

Other systems are either permanent solutions or do not have a complete system in one unit.

Our unit allows people to play a round of golf. Then when finished, close the unit and use the space for other purposes. For example, the customer can play golf, fold up the unit and pull their car back in the garage.

As can be seen, there is a need for a storable golf simulator.

SUMMARY OF THE INVENTION

In one aspect of the present invention, a fold-away golf simulator comprises a cabinet having bifold doors; a hinged deck extending from a base of the cabinet; a high impact screen mounted in the cabinet on a rear wall thereof; and a ceiling-mounted projector, operative to illuminate the high impact screen; wherein the hinged deck has an unfolded, horizontal use position and a folded, vertical storage position, and wherein the hinged deck abuts the high impact screen in the folded, vertical storage position.

These and other features, aspects and advantages of the present invention will become better understood with reference to the following drawings, description, and claims.

DETAILED DESCRIPTION OF THE INVENTION

Figure 1:
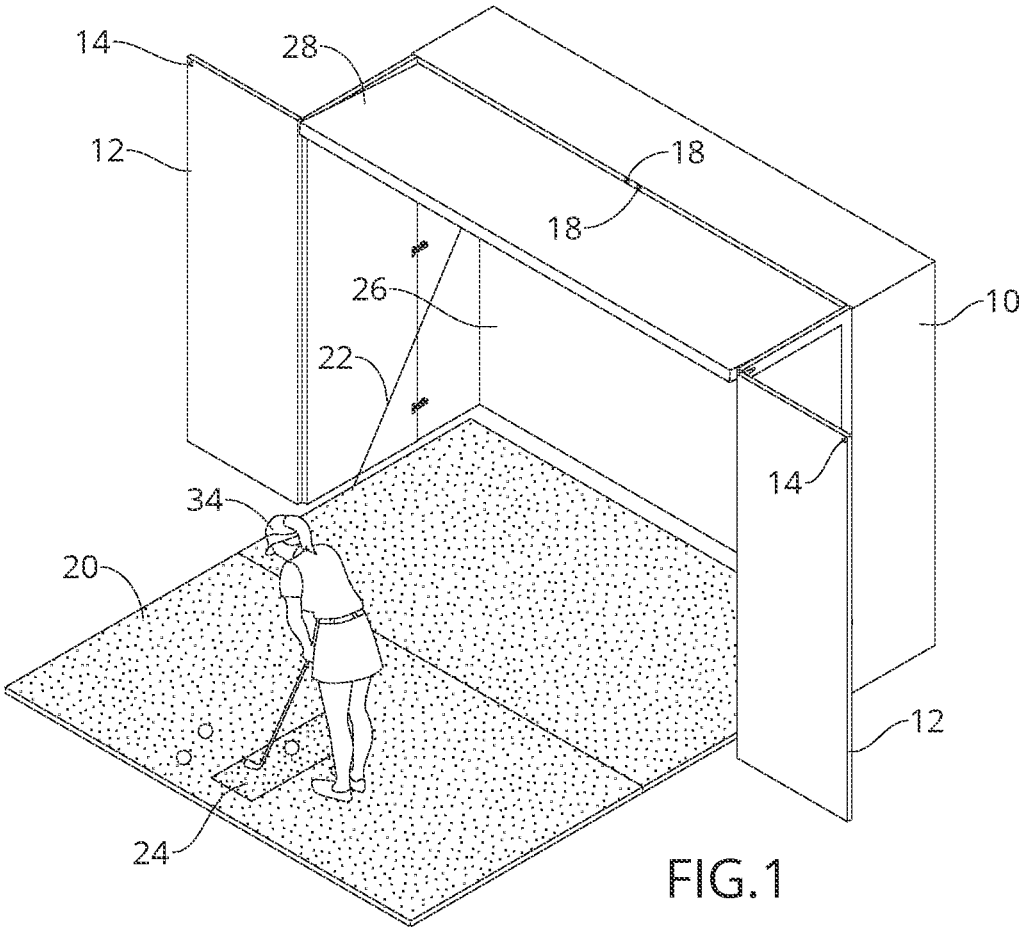
FIG. 1 is a perspective view of a golf simulator according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a fold out golf simulator that allows the customer to use their space as needed, but can fold out their simulator to play golf.

The claimed invention differs from what currently exists. Other retractable simulators are only screen and side protection. The customer still needs to move the turf. Our system has fold out decks that provide the hitting and putting area.

This invention is an improvement on what currently exists. Other retractable simulators are only screen and side protection. The customer still needs to move the turf. Our system has fold out decks that provide the hitting and putting area.

The other units either take a complete room or garage, or just utilize retractable screens and sides.

Our unit allows people to play a round of golf. Then when finished, close the unit and use the space for other purposes. For example, the customer can play golf, fold up the unit and pull their car back in the garage.

In an embodiment of the present invention, a golf simulator assembly comprises a Frame, an Electric Hoist, Bifold Doors, Fold-Out Decks, and Skyshield Protection.

The customer uses a Murphy Golf Simulator to allow their space to be multi-purpose. They would use the invention to play golf and close everything to be able to use the space for other purposes. TO use the Murphy Golf Simulator, the customer opens the doors, raises the skyshield and then presses a button on a remote to lower the decks. The skyshield and decks use gas struts to help automate the movement.

The Murphy Golf Simulator can be built from wood, aluminum or other material strong enough to frame the cabinet. A hoist is mounted and cable is run through a pulley system to easily and safely raise and lower the turfed decks. The skyshield is a padded and attached at the top inside portion of the cabinet and raises using gas struts. The doors are bifold doors that are used to enclose everything in the cabinet and also open to serve as sidewall protection.

The doors could be excluded and curtains could be used in their place.

Referring to FIGS. 1 through 7, FIG. 1 shows a golf simulator unit in use according to an embodiment of the present invention. A user 34 stands on a mat 20 extending from a cabinet 10 and joined thereto with support cables 22, the mat 20 having a strike pad 24 thereon. The cabinet 10 has bifold doors 12 with door center closure magnets 14 and a sky shield 28 with cabinet door closure magnets 18, enclosing impact screen 26.

Figure 2:
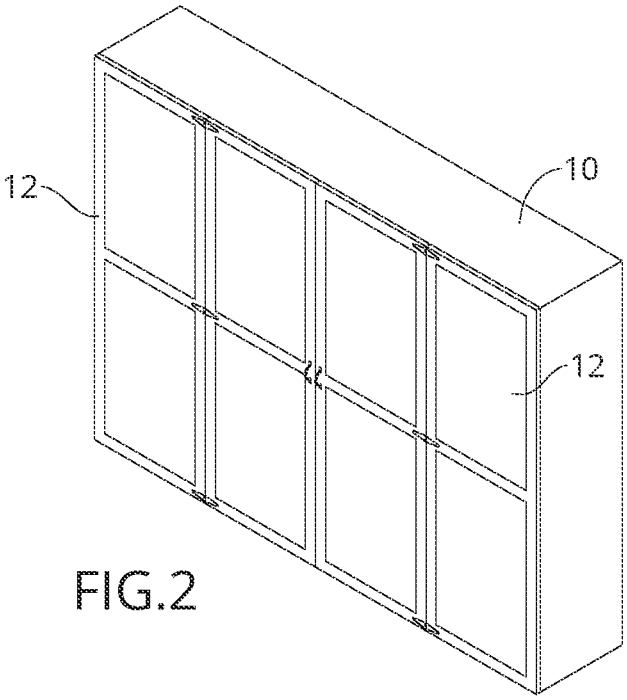
FIG. 2 is another perspective view thereof, shown in a storage position.
Figure 3:
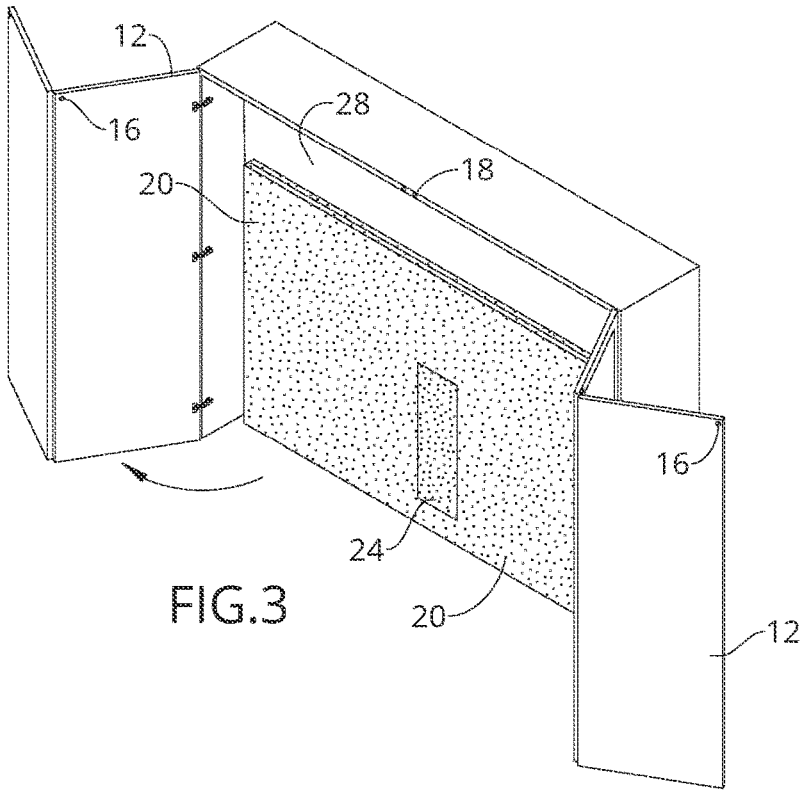
FIG. 3 is another perspective view thereof, shown in a partially opened position.
Figure 4:
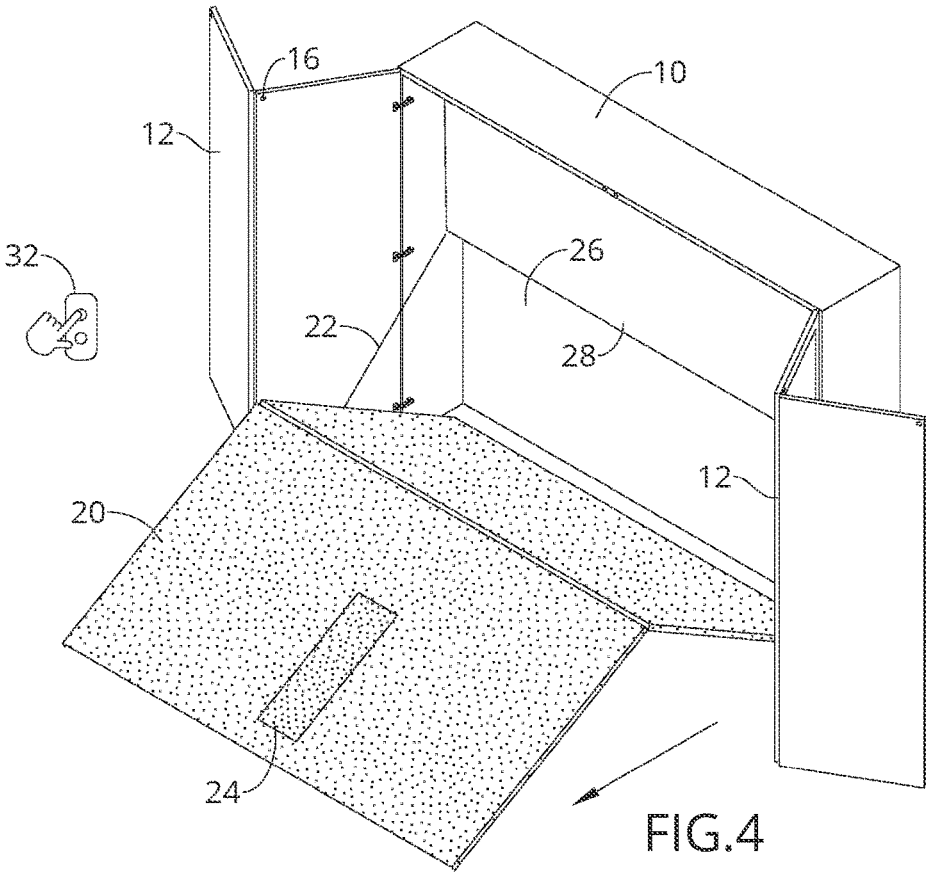
FIG. 4 is another perspective view thereof, shown in a remote deployment configuration.
Figure 5:
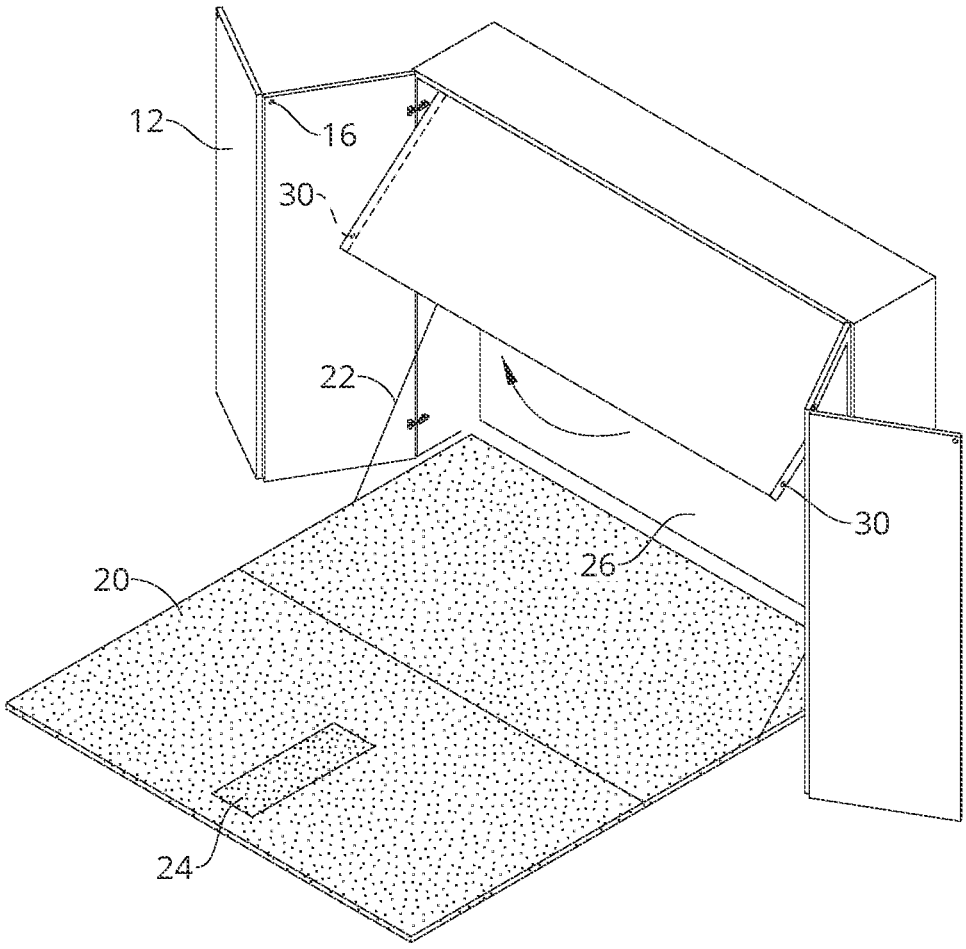
FIG. 5 is another perspective view thereof, show with a raised sky shield.

The cabinet is shown in a closed position in FIG. 2. Deployment of the unit is shown in FIGS. 3-5, which may be operated using a remote control 32, as shown in FIG. 4.

Figure 6:
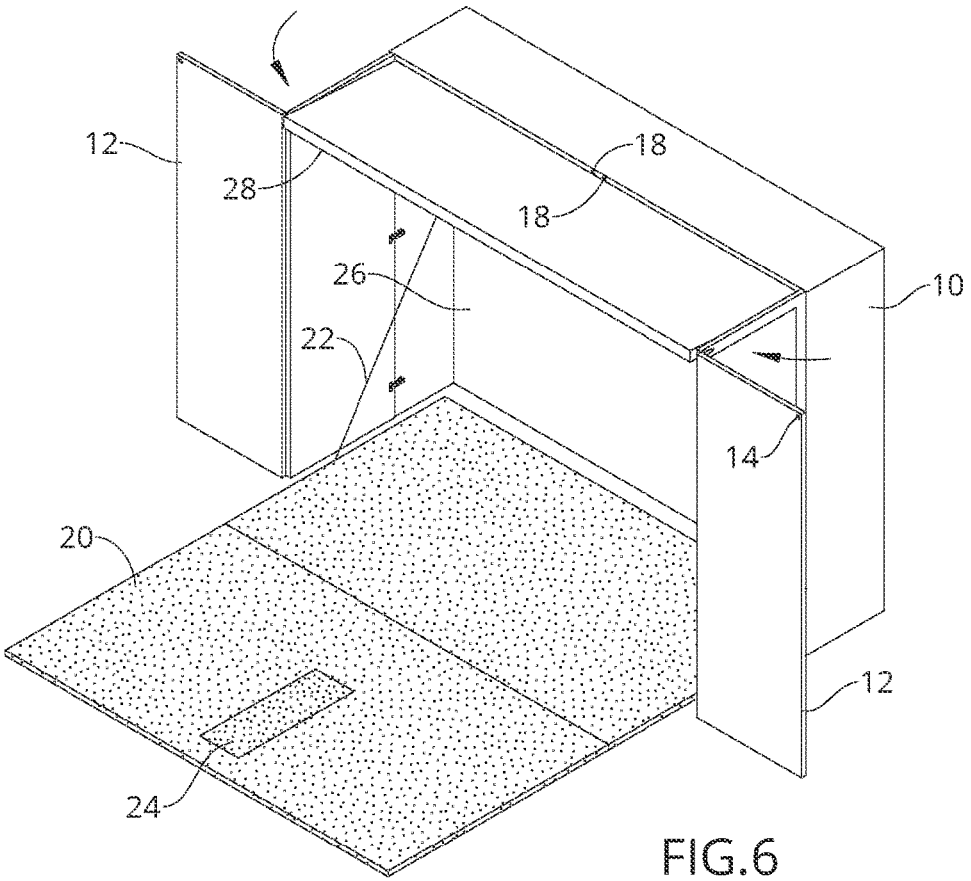
FIG. 6 is another perspective view thereof.

Each door 12 has a door sky shield attachment magnet 16. The sky shield 28 may have sky shield magnets 30, as shown in FIG. 5. As shown in FIG. 6, the doors 12 and the sky shield 28 may be fastened together by the magnets 16 and 30 in a deployed position.

Figure 7:
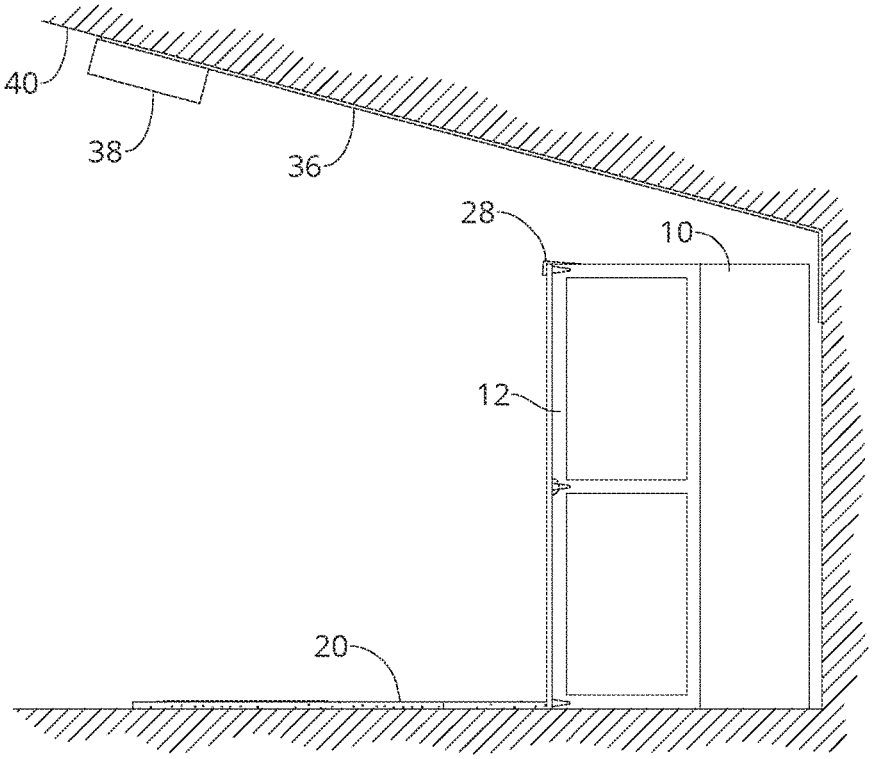
FIG. 7 is a side view thereof.

FIG. 7 illustrates an exemplary placement of a projector 38, installed on a ceiling 40 with a projector bracket 36 in a manner that displays an image on the impact screen 26.

It should be understood, of course, that the foregoing relates to exemplary embodiments of the invention and that modifications may be made without departing from the spirit and scope of the invention as set forth in the following claims.

What is claimed is:

1. A fold-away golf simulator, comprising:

a) a cabinet having bifold doors;

b) a foldable hinged deck extending from a base of the cabinet;

c) a high impact projection screen mounted in the cabinet on a rear wall thereof; and d) a shield mounted within the cabinet and configured to rotate upward from a storage position to extend beyond an upper portion of the cabinet when the shield is deployed;

wherein the foldable hinged deck has an unfolded, horizontal use position and a folded, vertical storage position, and wherein the foldable hinged deck abuts the high impact projection screen in the folded, vertical storage position.

2. The fold-away golf simulator of claim 1, further comprising an electric hoist system including a cable and pulley assembly configured to raise and lower the foldable hinged deck.

3. The fold-away golf simulator of claim 2, wherein the electric hoist system is operated by remote control.

4. The fold-away golf simulator of claim 1, wherein the shield comprises magnets configured to secure the shield to the bifold doors when the fold-away golf simulator is deployed.

5. The fold-away golf simulator of claim 1, wherein the foldable hinged deck comprises a strike pad positioned distal to the cabinet when the foldable hinged deck is in the unfolded, horizontal use position.

6. The fold-away golf simulator of claim 1, further comprising a ceiling-mounted projector operative to illuminate the high impact projection screen.

7. The fold-away golf simulator of claim 1, wherein the cabinet is configured to be mounted adjacent to a wall.

8. The fold-away golf simulator of claim 1, further comprising a gas strut support configured to move the shield between the storage position and a deployed position.

9. The fold-away golf simulator of claim 1, further comprising at least one strut configured to move the deck between the folded, vertical storage position and the unfolded, horizontal use position.

10. The fold-away golf simulator of claim 1, wherein the shield is padded.

* * * * *